US011694670B2

(12) United States Patent
Sakamoto

(10) Patent No.: US 11,694,670 B2
(45) Date of Patent: Jul. 4, 2023

(54) ACTIVE NOISE CONTROL DEVICE AND VEHICLE

(71) Applicant: HONDA MOTOR CO., LTD., Tokyo (JP)

(72) Inventor: Kosuke Sakamoto, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 17/578,036

(22) Filed: Jan. 18, 2022

(65) Prior Publication Data

US 2022/0230618 A1 Jul. 21, 2022

(30) Foreign Application Priority Data

Jan. 20, 2021 (JP) ..... 2021-007119

(51) Int. Cl.
*G10K 11/178* (2006.01)
*G10L 21/0232* (2013.01)

(52) U.S. Cl.
CPC .. *G10K 11/17854* (2018.01); *G10K 11/17823* (2018.01); *G10K 11/17825* (2018.01); *G10K 11/17881* (2018.01); *G10K 11/17883* (2018.01); *G10L 21/0232* (2013.01); *G10K 2210/12* (2013.01); *G10K 2210/12821* (2013.01); *G10K 2210/3028* (2013.01)

(58) Field of Classification Search
CPC ... G10K 2210/12821; G10K 11/17823; G10K 11/17883
See application file for complete search history.

(56) References Cited

U.S. PATENT DOCUMENTS

2009/0060217 A1 3/2009 Sakamoto et al.
2011/0170701 A1* 7/2011 Sakamoto ..... G10K 11/17879 381/73.1
2013/0136270 A1 5/2013 Sakamoto et al.
2013/0315409 A1 11/2013 Inoue et al.
2020/0388267 A1* 12/2020 Bastyr ..... G10K 11/17837

FOREIGN PATENT DOCUMENTS

EP 1 772 852 A1 4/2007
JP H07-281676 A 10/1995
JP 2006-335136 A 12/2006
JP 2007-025527 A 2/2007
JP 2008-216375 A 9/2008
JP 2009-057018 A 3/2009
JP 2013-242459 A 12/2013
JP 5616313 B2 10/2014

* cited by examiner

*Primary Examiner* — Ping Lee
(74) *Attorney, Agent, or Firm* — Carrier, Shende & Associates, P.C.; Joseph P. Carrier; Fulchand P. Shende

(57) ABSTRACT

An active noise control device includes a basic signal generating unit configured to generate a basic signal corresponding to a resonance frequency of a vibration sensor, a first adaptive filter configured to generate a sensor resonance simulation signal simulating a signal acquired while the vibration sensor is resonating by performing a filtering process on the basic signal, a computation unit configured to calculate a second reference signal that is a difference between a first reference signal acquired by the vibration sensor and the sensor resonance simulation signal, and a second adaptive filter configured to generate a control signal by performing a filtering process on the second reference signal.

6 Claims, 4 Drawing Sheets

ACTIVE NOISE CONTROL DEVICE
10
12
18
X
Y
Z
rx1
ry1
rz1
REFERENCE SIGNAL GENERATING UNIT
22
RESONANCE FREQUENCY IDENTIFYING UNIT
44X
44Y
44Z
f0x
f0y
f0z
26X
26Y
26Z
BASIC SIGNAL GENERATING UNIT
28X
28Y
28Z
sx
sy
sz
Wrx
Wry
Wrz
30X
30Y
30Z
mx
my
mz
LMS
34X
34Y
34Z
32X
32Y
32Z
rx2
ry2
rz2
CONTROL SIGNAL GENERATING UNIT
24
Wx
Wy
Wz
36X
36Y
36Z
ĉ
38X
38Y
38Z
LMS
40X
40Y
40Z
uOx
uOy
uOz
42
u
e
POWER AMP
15
16
20

ACTIVE NOISE CONTROL DEVICE AND VEHICLE

CROSS-REFERENCE TO RELATED APPLICATIONS

This application is based upon and claims the benefit of priority from Japanese Patent Application No. 2021-007119 filed on Jan. 20, 2021, the contents of which are incorporated herein by reference.

BACKGROUND OF THE INVENTION

Field of the Invention

The present invention relates to an active noise control device and a vehicle.

Description of the Related Art

JP 2006-335136 A discloses an active vibration noise control device including a sensor, a noise computation unit, and a controller. The sensor measures vibration of a vehicle body. The noise computation unit calculates noise in the vehicle compartment based on the vibration of the vehicle body. The controller controls an active part for generating a control sound according to the noise in the vehicle compartment.

SUMMARY OF THE INVENTION

However, in JP 2006-335136 A, it is not always possible to suitably reduce noise when resonance occurs in the sensor.

An object of the present invention is to provide an active noise control device and a vehicle which can reduce noise suitably.

An active noise control device according to one aspect of the present invention causes an actuator to output a canceling sound based on a control signal in order to reduce noise in a vehicle compartment of a vehicle, and includes a basic signal generating unit configured to generate a basic signal corresponding to a resonance frequency of a vibration sensor provided at the vehicle, a first adaptive filter configured to generate a sensor resonance simulation signal simulating a signal acquired while the vibration sensor is resonating by performing a filtering process on the basic signal, a computation unit configured to calculate a second reference signal that is a difference between a first reference signal acquired by the vibration sensor and the sensor resonance simulation signal, and a second adaptive filter configured to generate the control signal by performing a filtering process on the second reference signal, the filtering process being different from the filtering process performed by the first adaptive filter.

A vehicle according to another aspect of the present invention includes the active noise control device as described above.

According to the present invention, it is possible to provide an active noise control device and a vehicle which can reduce noise suitably.

The above and other objects, features, and advantages of the present invention will become more apparent from the following description when taken in conjunction with the accompanying drawings in which a preferred embodiment of the present invention is shown by way of illustrative example.

DESCRIPTION OF THE INVENTION

Preferred embodiments of an active noise control device and a vehicle according to the present invention will be described in detail below with reference to the accompanying drawings.

First Embodiment

Figure 1:
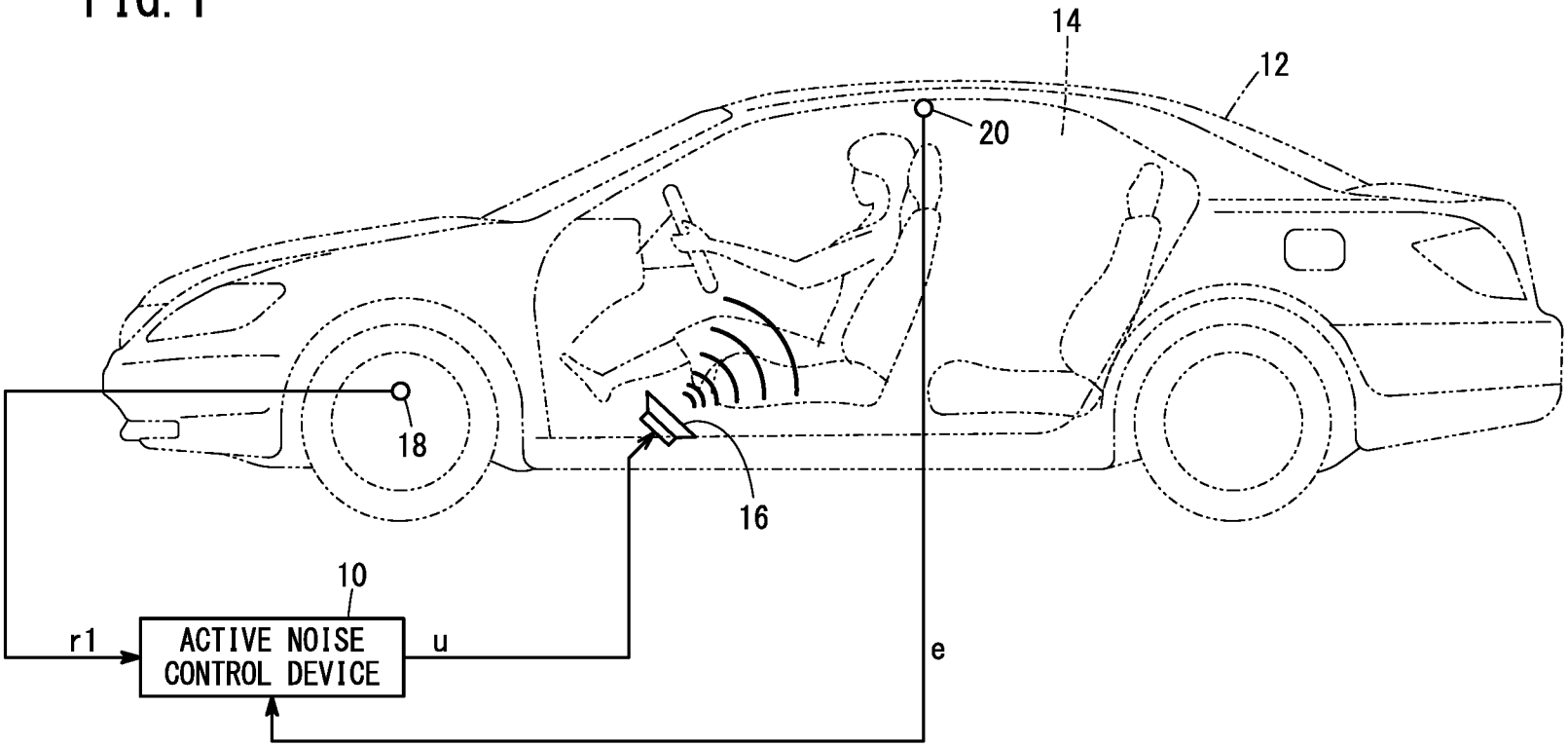
FIG. 1 is a diagram illustrating an outline of active noise control.

An active noise control device and a vehicle according to a first embodiment will be described with reference to FIGS. 1 and 2. FIG. 1 is a diagram illustrating an outline of active noise control.

An active noise control device 10 causes an actuator 16 to output a canceling sound for reducing noise (vibration noise) in a vehicle compartment 14 of a vehicle 12.

The noise in the vehicle compartment 14 may include, for example, road noise. Road noise is noise that is transmitted to an occupant in the vehicle compartment 14 when a wheel vibrates due to force received from the road surface and the vibration of the wheel is transmitted to the vehicle body via a suspension.

The vehicle 12 is provided with a vibration sensor 18 that detects vibration of the vehicle 12. Signals r1 detected by vibration sensor 18 are supplied to the active noise control device 10. That is, signals indicating vibration are supplied to the active noise control device 10.

A microphone 20 is further provided in the vehicle compartment 14. The microphone 20 detects residual noise (cancellation error noise) due to interference between the noise and the canceling sound output from the actuator 16. The residual noise detected by the microphone 20 is supplied to the active noise control device 10. That is, an error signal e detected by the microphone 20 is supplied to the active noise control device 10.

The active noise control device 10 generates a control signal u for outputting a canceling sound from the actuator 16, based on the signal r1 detected by the vibration sensor 18 and the error signal e detected by the microphone 20. More specifically, the active noise control device 10 generates the control signal u such that the error signal e detected by the microphone 20 is minimized. Since the actuator 16 outputs the canceling sound based on the control signal u that minimizes the error signal e detected by the microphone 20, the noise in the vehicle compartment 14 can be suitably canceled out by the canceling sound. In this way, the active noise control device 10 can reduce noise transmitted to an occupant in the vehicle compartment 14.

Resonance occurs in the vibration sensor 18. The signal r1 acquired by the resonant vibration sensor 18 includes resonance noise. When such a canceling sound is simply generated based on the signal r1 including relatively large resonance noise, it is not always possible to suitably cancel out the noise in the vehicle compartment 14 by the canceling sound. Although it is conceivable to remove such resonance noise using a low-pass filter, the use of a low-pass filter causes signal delay, which leads to a decrease in the noise control effect. As a result of intensive studies, the inventors of the present application have conceived the active noise control device 10 as described below.

Figure 2:
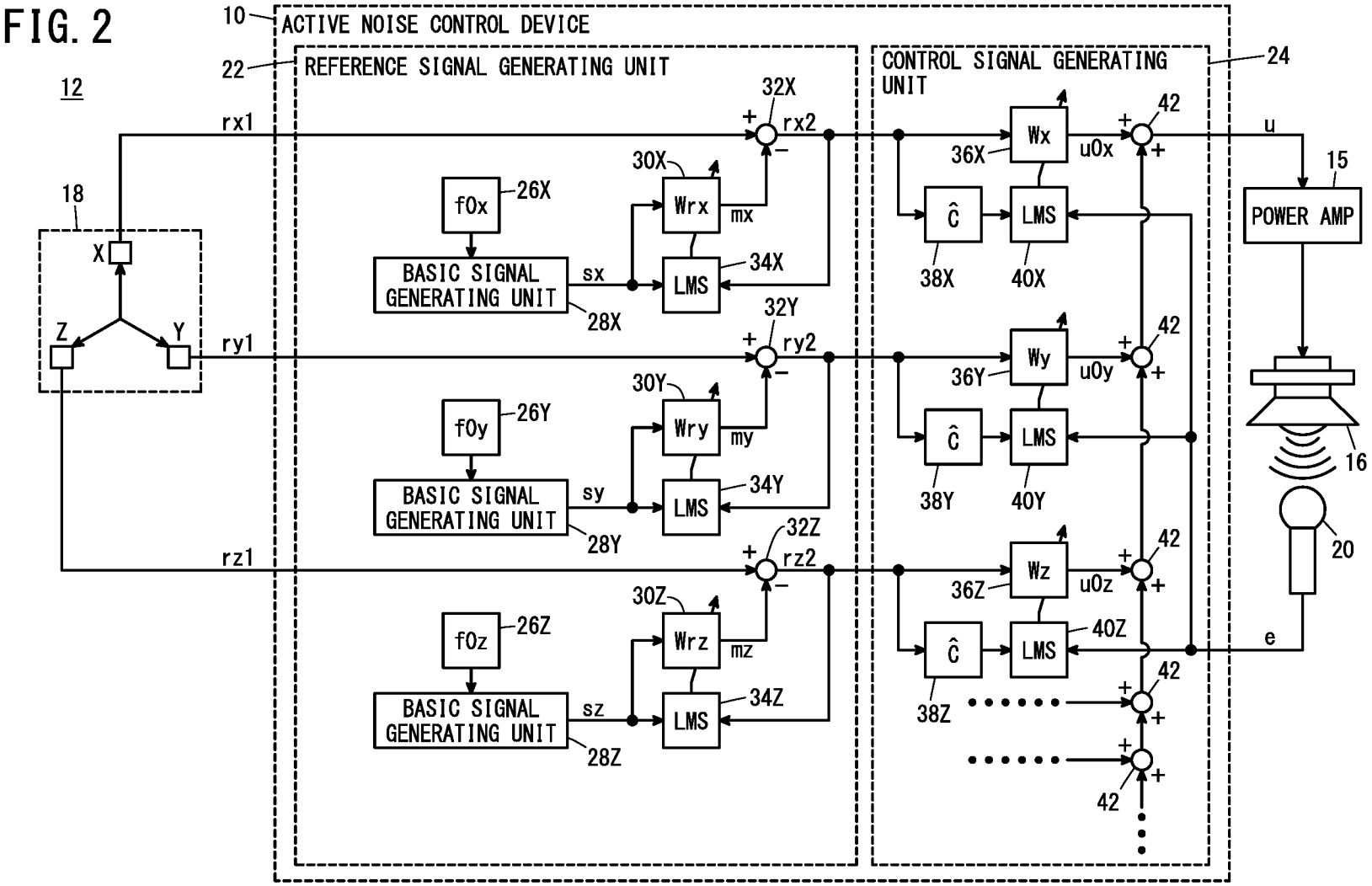
FIG. 2 is a block diagram illustrating a part of a vehicle provided with the active noise control device according to the first embodiment.

FIG. 2 is a block diagram illustrating a part of a vehicle equipped with the active noise control device according to the present embodiment.

As shown in FIG. 2, the active noise control device 10 includes a reference signal generating unit 22 and a control signal generating unit 24.

The reference signal generating unit 22 includes resonance frequency storage units 26X to 26Z, basic signal generating units 28X to 28Z, first adaptive filters 30X to 30Z, computation units 32X to 32Z, and first filter coefficient updating units 34X to 34Z.

The control signal generating unit 24 includes second adaptive filters 36X, 36Y, and 36Z, acoustic characteristic filters 38X, 38Y, and 38Z, second filter coefficient updating units 40X, 40Y, and 40Z, and computation units 42.

The active noise control device 10 includes a computation device (computational processing device) (not shown). The computation device may be configured by a processor such as a CPU (Central Processing Unit), a DSP (Digital Signal Processor), or the like. However, the present invention is not limited to this feature. A DDS (Direct Digital Synthesizer), a DCO (Digitally Controlled Oscillator), or the like can be included in the computation device. In addition, an ASIC (Application Specific Integrated Circuit), an FPGA (Field-Programmable Gate Array), or the like can be included in the computation device.

The active noise control device 10 includes a storage device (not shown). Such a storage device may be configured by a volatile memory (not shown) and a nonvolatile memory (not shown). Examples of the volatile memory include, for example, a RAM or the like. Examples of the nonvolatile memory include, for example, a ROM, a flash memory, or the like. Programs, tables, maps, and the like may be stored, for example, in the nonvolatile memory.

The resonance frequency storage units 26X to 26Z are provided in the storage device. The basic signal generating units 28X to 28Z, the first adaptive filters 30X to 30X, the computation units 32X to 32Z, and the first filter coefficient updating units 34X to 34Z can be realized by programs, which are stored in the storage device, being executed by the computation device.

The second adaptive filters 36X, 36Y, and 36Z, the acoustic characteristic filters 38X, 38Y, and 38Z, the second filter coefficient updating units 40X, 40Y, and 40Z, and the computation units 42 can be realized by programs, which are stored in the storage device, being executed by the computation device.

The vehicle 12 may be provided with a vibration sensor 18, in particular an acceleration sensor. More specifically, for example, a three-axis acceleration sensor can be used as the vibration sensor 18. The three axes are the X-axis, the Y-axis and the Z-axis. The vibration in the X-axis direction detected by the vibration sensor 18 is supplied to the active noise control device 10 as a first reference signal rx1. The vibration in the Y-axis direction detected by the vibration sensor 18 is supplied to the active noise control device 10 as a first reference signal ry1. The vibration in the Z-axis direction detected by the vibration sensor 18 is supplied to the active noise control device 10 as a first reference signals rz1. The reference character r1 is used when describing the first reference signal in general. The reference characters rx1, ry1, and rz1 are used when describing individual first reference signals.

As described above, the microphone 20 that detects the residual noise due to interference between the noise and the canceling sound is provided in the vehicle compartment 14 (see FIG. 1). That is, the microphone 20 for detecting the error signal e is provided in the vehicle compartment 14.

As described above, the vehicle compartment 14 (see FIG. 1) is provided with the actuator 16 that outputs a canceling sound based on the control signal u. As examples of the actuator 16, there may be cited a speaker.

As described above, the reference signal generating unit 22 includes the resonance frequency storage units (resonance frequency storing units) 26X, 26Y, 26Z. The resonance frequency storage units 26X, 26Y, 26Z store resonance frequency information indicating the resonance frequencies f0$x$, f0$y$, and f0$z$ of the vibration sensor 18. The resonance frequency storage unit 26X stores the resonance frequency f0$x$ of the vibration sensor 18 in the X-axis direction. The resonance frequency storage unit 26Y stores the resonance frequency f0$y$ of the vibration sensor 18 in the Y-axis direction. The resonance frequency storage unit 26Z stores the resonance frequency f0$z$ of the vibration sensor 18 in the Z-axis direction. The reference character 26 is used when describing the resonance frequency storage unit in general. The reference characters 26X, 26Y, and 26Z are used when describing individual resonance frequency storage units. The reference character f0 is used when describing the resonance frequency in general. The reference characters f0$x$, f0$y$, and f0$z$ are used when describing individual resonance frequencies.

As described above, the reference signal generating unit 22 includes the basic signal generating units 28X, 28Y, and 28Z. The basic signal generating unit 28X generates a basic signal sx corresponding to the resonance frequency f0$x$ of the vibration sensor 18 in the X-axis direction based on the resonance frequency information stored in the resonance frequency storage unit 26X. The basic signal generating unit 28Y generates a basic signal sy corresponding to the resonance frequency f0$y$ of the vibration sensor 18 in the Y-axis direction based on the resonance frequency information stored in the resonance frequency storage unit 26Y. The basic signal generating unit 28Z generates a basic signal sz corresponding to the resonance frequency f0$z$ of the vibration sensor 18 in the Z-axis direction based on the resonance frequency information stored in the resonance frequency storage unit 26Z. The reference character 28 is used when describing the basic signal generating unit in general. The reference characters 28X, 28Y, and 28Z are used when describing the individual basic signal generating units. The reference character s is used when describing the basic signal in general. The reference characters sx, sy, and sz are used when describing the individual basic signals. The basic signal generating unit 28 can be realized by a direct digital synthesizer, a digitally controlled oscillator, or the like, but is not limited thereto.

As described above, the reference signal generating unit 22 includes the first adaptive filters 30X, 30Y, 30X. The first adaptive filter 30X generates a sensor resonance simulation signal mx that simulates a signal acquired while the vibration sensor 18 is resonating in the X-axis direction by performing a filtering process on the reference signal sx. The first adaptive filter 30Y generates a sensor resonance simulation signal my that simulates a signal acquired while the vibration sensor 18 is resonating in the Y-axis direction by performing a filtering process on the reference signal sy. The first adaptive filter 30Z generates a sensor resonance simulation signal mz that simulates a signal acquired while the vibration sensor 18 is resonating in the Z-axis direction by performing a filtering process on the reference signal sz. The reference character 30 is used when describing the first adaptive filter in general, whereas the reference characters 30X, 30Y, and 30Z are used when describing the individual first adaptive filters. The reference character m is used when describing the sensor resonance simulation signal in general. The reference characters mx, my, and mz are used when describing the individual sensor resonance simulation signals. As the first adaptive filter 30, for example, a notch filter or the like can be used. As examples of such a notch filter, there may be cited a SAN (single-frequency adaptive notch) filter, but the present invention is not limited to this feature. The notch filter is used as the first adaptive filter 30 because the notch filter has an advantage of having a shorter delay time than a low-pass filter or the like. The frequency (notch frequency) blocked by the first adaptive filter 30 is the resonance frequency f0. The filter coefficients Wrx, Wry, and Wrz of the first adaptive filters 30X, 30Y, and 30Z can be updated by the first filter coefficient updating units 34X, 34Y, and 34Z, as will be described later. The reference character Wr is used when describing the filter coefficient in general. The reference characters Wrx, Wry, and Wrz are used when describing the individual filter coefficients. When the magnitude of the component of the resonance frequency f0 is relatively large in the first reference signal r1, the filter coefficient Wr of the first adaptive filter 30 can be set such that the amount of attenuation for the component of the resonance frequency f0 is relatively small in the first adaptive filter 30. On the other hand, when the magnitude of the component of the resonance frequency f0 is relatively small in the first reference signal r1, the filter coefficient Wr of the first adaptive filter 30 can be set such that the amount of attenuation for the component of the resonance frequency f0 is relatively large in the first adaptive filter 30.

The first adaptive filter 30 is not limited to a notch filter. The first adaptive filter 30 can also be configured by a bandpass filter or the like. Even when a bandpass filter is used as the first adaptive filter 30, the filter coefficient Wr of the first adaptive filter 30 can be set as follows. That is, when the magnitude of the component of the resonance frequency f0 is relatively large in the first reference signal r1, the filter coefficients Wr of the first adaptive filter 30 can be set such that the amount of attenuation for the component of the resonance frequency f0 is relatively small in the first adaptive filter 30. On the other hand, when the magnitude of the component of the resonance frequency f0 is relatively small in the first reference signal r1, the filter coefficients Wr of the first adaptive filter 30 can be set such that the amount of attenuation for the component of the resonance frequency f0 is relatively large in the first adaptive filter 30.

As described above, the reference signal generating unit 22 includes the computation units 32X, 32Y, and 32Z. The computation unit 32X calculates the second reference signal rx2 that is a difference between the first reference signal rx1 acquired by the vibration sensor 18 and the sensor resonance simulation signal mx. More specifically, the computation unit (subtractor) 32X generates the second reference signal rx2 by subtracting the sensor resonance simulation signal mx from the first reference signal rx1 acquired by the vibration sensor 18. The computation unit 32Y calculates the second reference signal ry2 that is a difference between the first reference signal ry1 acquired by the vibration sensor 18 and the sensor resonance simulation signal my. More specifically, the computation unit (subtractor) 32Y generates the second reference signal ry2 by subtracting the sensor resonance simulation signal my from the first reference signal ry1 acquired by the vibration sensor 18. The computation unit 32Z calculates the second reference signal rz2 which is a difference between the first reference signal rz1 acquired by the vibration sensor 18 and the sensor resonance simulation signal mz. More specifically, the computation unit (subtractor) 32Z generates the second reference signal rz2 by subtracting the sensor resonance simulation signal mz from the first reference signal rz1 acquired by the vibration sensor 18. The reference character 32 is used when describing the computation unit in general. The reference characters 32X, 32Y, and 32Z are used when describing the individual computation units. The reference character r2 is used when describing the second reference signal in general. The reference characters rx2, ry2, and rz2 are used when individual second reference signals are described.

As described above, the reference signal generating unit 22 includes the first filter coefficient updating units 34X, 34Y, and 34Z. The first filter coefficient updating unit 34X updates the filter coefficient Wrx of the first adaptive filter 30X such that the magnitude of the component of the resonance frequency f0$x$ of the vibration sensor 18 in the X-axis direction is minimized in the second reference signal rx2. The first filter coefficient updating unit 34Y updates the filter coefficient Wry of the first adaptive filter 30Y such that the magnitude of the component of the resonance frequency f0$y$ of the vibration sensor 18 in the Y-axis direction is minimized in the second reference signal ry2. The first filter coefficient updating unit 34Z updates the filter coefficient Wrz of the first adaptive filter 30Z such that the magnitude of the component of the resonance frequency f0$z$ of the vibration sensor 18 in the Z-axis direction is minimized in the second reference signal rz2. The reference character 34 is used when describing the first filter coefficient updating unit in general. The reference characters 34X, 34Y, and 34Z are used when describing each of the first filter coefficient updating units. In updating the filter coefficient Wr, for example, an LMS (Least Mean Square) algorithm can be used, but the present invention is not limited to this feature.

The filter coefficient Wr can be updated by the first filter coefficient updating unit 34 as follows, for example.

The following expression (1) is established among the first reference signal r1, the second reference signal r2, and the basic signal s.

$$r2=r1-Wr\cdot s \tag{1}$$

The basic signal s corresponds to the resonance frequency f0 of the vibration sensor 18, and is expressed by the following expression (2).

$$s=\cos(2\cdot\pi\cdot f0\cdot t)+i\cdot\sin(2\cdot\pi\cdot f0\cdot t) \tag{2}$$

The first reference signal r1 includes a component having the same frequency as that of the basic signal s and a component q having a frequency different from that of the basic signal s. Therefore, the first reference signal r1 is expressed by the following expression (3).

$$r1=A\cdot s+q \tag{3}$$

The first filter coefficient updating unit 34 acquires a filter coefficient Wr that minimizes a square error as follows. That is, the first filter coefficient updating unit 34 acquires the filter coefficient Wr that minimizes the square of the second reference signal r2.

$$|r2|^2\rightarrow\min$$

The minimum square of the second reference signal r2 means that the magnitude of the component of the resonance frequency f0 of the vibration sensor 18 is minimized in the second reference signal r2.

The expression $|r2|^2$ is a quadratic function of the filter coefficient Wr.

Further, when a relationship such as the following expression (4) is established, a filter coefficient Wr of the first adaptive filter 30 is Wreso.

$$\frac{\partial |r2|^2}{\partial Wr} = 0 \tag{4}$$

In the case of Wr>Wreso, the following expression (5) is obtained.

$$\frac{\partial |r2|^2}{\partial Wr} > 0 \tag{5}$$

Note that Wreso corresponds to an amplitude of the component of the resonance frequency f0 of the vibration sensor 18.

On the other hand, in the case of Wr<Wreso, the following expression (6) is obtained.

$$\frac{\partial |r2|^2}{\partial Wr} < 0 \tag{6}$$

Then, assuming that the filter coefficient of the first adaptive filter 30 before the update is Wr(n), the filter coefficient Wr(n+1) of the first adaptive filter 30 after the update is expressed by the following expression (7).

$$\begin{aligned} Wr_{(n+1)} &= Wr_{(n)} - \alpha \cdot \frac{\partial |r2|^2}{\partial Wr} \\ &= Wr_{(n)} - 2 \cdot \alpha \cdot r2 \cdot \frac{\partial |r2|}{\partial Wr} \\ &= Wr_{(n)} - 2 \cdot \alpha \cdot r2 \cdot s \\ &= Wr_{(n)} - \mu \cdot r2 \cdot s \end{aligned} \tag{7}$$

The values α and μ are step-size parameters. The relationship between μ and α is expressed by the following expression (8).

$$\mu = 2 \cdot \alpha \tag{8}$$

As described above, in the present embodiment, the filter coefficient Wr of the first adaptive filter 30 is updated such that the magnitude of the component of the resonance frequency f0 of the vibration sensor 18 is minimized in the second reference signal r2. Therefore, according to the present embodiment, the magnitude of the component of the resonance frequency f0 of the vibration sensor 18 is sufficiently reduced in the second reference signal r2 even when the resonance frequency f0 has fluctuated and/or even when the magnitude of the component of the resonance frequency f0 has fluctuated. For this reason, according to the present embodiment, it is possible to acquire a good second reference signal r2 corresponding to vibration of the vehicle 12.

As described above, the control signal generating unit 24 includes the second adaptive filters 36X, 36Y, and 36Z. The second adaptive filter 36X generates the control signal u0*x* by performing on the second reference signal rx2 a filtering process that is different from the filtering process performed by the first adaptive filter 30X. The second adaptive filter 36Y generates the control signal u0*y* by performing on the second reference signal ry2 a filtering process that is different from the filtering process performed by the first adaptive filter 30Y. The second adaptive filter 36Z generates the control signal u0*z* by performing on the second reference signal rz2 a filtering process that is different from the filtering process performed by the first adaptive filter 30Z. The reference character 36 is used when describing the second adaptive filter in general. The reference characters 36X, 36Y, and 36Z are used when describing the individual second adaptive filters. The reference character u0 is used when describing a control signal in general. The reference characters u0*x*, u0*y*, and u0*x* are used when describing the individual control signals. As the second adaptive filter 36, for example, an FIR (Finite Impulse Response) filter or the like can be used, but the present invention is not limited to this feature. The filter coefficients of the second adaptive filters 36X, 36Y, and 36Z are updated by second filter coefficient updating units 40X, 40Y, and 40Z, as described later. The FIR filter generates the control signal u0 by performing a convolution operation on the second reference signal r2.

As described above, the control signal generating unit 24 includes the acoustic characteristic filters 38X, 38Y, and 38Z. The acoustic characteristic filter 38X corrects the second reference signal rx2 by performing a filtering process on the second reference signal rx2 according to an acoustic characteristic (transfer characteristic) from the actuator 16 to the microphone 20. The acoustic characteristic filter 38Y corrects the second reference signal ry2 by performing the filtering process on the second reference signal ry2 according to the acoustic characteristic from the actuator 16 to the microphone 20. The acoustic characteristic filter 38Z corrects the second reference signal rz2 by performing the filtering process on the second reference signal rz2 according to the acoustic characteristic from the actuator 16 to the microphone 20. The acoustic characteristic from the actuator 16 to the microphone 20 is acquired in advance. That is, the transfer characteristic $\hat{C}$ from the actuator 16 to the microphone 20 is acquired in advance. The reference character 38 is used when describing the acoustic characteristic filter in general. The reference characters 38X, 38Y, and 38Z are used when describing the individual acoustic characteristic filters.

As described above, the control signal generating unit 24 includes the second filter coefficient updating units 40X, 40Y, and 40Z. The second filter coefficient updating unit 40X updates the filter coefficient Wx of the second adaptive filter 36X such that the error signal e, which is acquired by detecting the residual noise due to the interference between the noise and the canceling sound by the microphone 20, is minimized. The second filter coefficient updating unit 40Y updates the filter coefficient Wy of the second adaptive filter 36Y such that the error signal e, which is acquired by detecting the residual noise due to the interference between the noise and the canceling sound by the microphone 20, is minimized. The second filter coefficient updating unit 40Z updates the filter coefficient Wz of the second adaptive filter 36Z such that the error signal e, which is acquired by detecting the residual noise due to the interference between the noise and the canceling sound by the microphone 20, is minimized. The reference character 40 is used when describing the second filter coefficient updating unit in general. The reference characters 40X, 40Y, and 40Z are used when describing the individual second filter coefficient updating units. The reference character W is used when describing the filter coefficient in general. The reference characters Wx, Wy, and Wz are used when describing the individual filter coefficients. When the filter coefficient W is updated, for example, a filtered-X LMS algorithm can be used, but the present invention is not limited to this feature.

Although one vibration sensor 18 is illustrated in FIG. 2, a plurality of the vibration sensors 18 may be provided in the vehicle 12. Components such as those described above may be provided for each of the vibration sensors 18.

As described above, the control signal generation unit 24 further includes the computation units 42. The control signals u0 output from the respective second adaptive filters 36 are input to the computation units 42. The computation units 42 add the control signals u0 supplied from the respective second adaptive filters 36. The computation units (adders) 42 supply a control signal u generated by adding the plurality of control signals u0 to the actuator 16 via a power amplifier 15.

As described above, in the present embodiment, the second reference signal r2 is generated based on a difference between the first reference signal r1 acquired by the vibration sensor 18 and the sensor resonance simulation signal m that simulates a signal acquired while the vibration sensor 18 is resonating. Since the second reference signal r2 is generated by the difference between the first reference signal r1 and the sensor resonance simulation signal m, the magnitude of the component of the resonance frequency f0 of the vibration sensor 18 is reduced in the second reference signal r2. According to the present embodiment, since the control signal u for causing the actuator 16 to output a canceling sound is generated based on such a second reference signal r2, it is possible to provide the active noise control device 10 that is capable of reducing noise suitably even when the vibration sensor 18 resonates.

Second Embodiment

Figure 3:
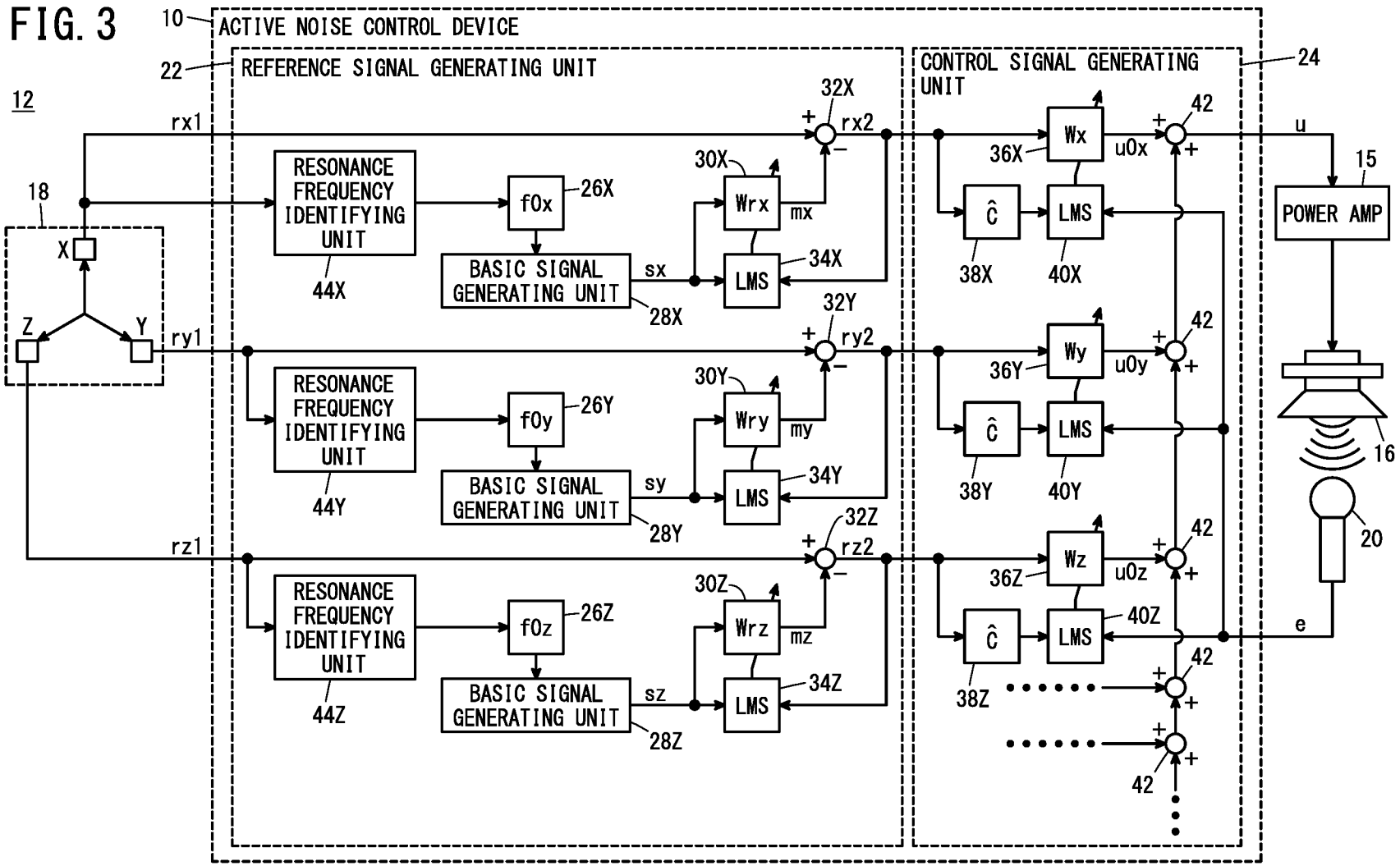
FIG. 3 is a block diagram illustrating a part of a vehicle provided with an active noise control device according to a second embodiment.

An active noise control device and a vehicle according to a second embodiment will be described with reference to FIG. 3. FIG. 3 is a block diagram illustrating a part of a vehicle equipped with the active noise control device according to the present embodiment. The same components as those of the active noise control device and the like according to the first embodiment shown in FIGS. 1 and 2 are denoted by the same reference characters, and description of such features is either omitted or simplified.

In the present embodiment, a resonance frequency identifying unit 44X is further provided. The resonance frequency identifying unit 44X identifies the resonance frequency f0*x* of the vibration sensor 18 in the X-axis direction by performing frequency analysis on the first reference signal rx1. Further, in the present embodiment, a resonance frequency identifying unit 44Y is further provided. The resonance frequency identifying unit 44Y identifies the resonance frequency f0*y* of the vibration sensor 18 in the Y-axis direction by performing frequency analysis on the first reference signal ry1. Further, in the present embodiment, a resonance frequency identifying unit 44Z is further provided. The resonance frequency identifying unit 44Z identifies the resonance frequency f0*z* of the vibration sensor 18 in the Z-axis direction by performing frequency analysis on the first reference signal rz1. The reference character 44 is used when describing the resonance frequency identifying unit in general. The reference characters 44X, 44Y, and 44Z are used when describing the individual resonance frequency identifying units. The resonance frequency identifying unit 44 can identify the resonance frequency f0 of the vibration sensor 18 by, for example, performing a Fourier transform on the first reference signal r1 supplied from the vibration sensor 18 and analyzing a frequency spectrum acquired by the Fourier transform. The resonance frequency identifying unit 44X stores the identified resonance frequency f0*x* in the X-axis direction in the resonance frequency storage unit 26X. The resonance frequency identifying unit 44Y stores the identified resonance frequency f0*y* in the Y-axis direction in the resonance frequency storage unit 26Y. The resonance frequency identifying unit 44Z stores the identified resonance frequency f0*z* in the Z-axis direction in the resonance frequency storage unit 26Z. The resonance frequency identifying unit 44 identifies the resonance frequency f0 as appropriate. The resonance frequency information indicating the resonance frequency f0 is updated as appropriate in the resonance frequency storage unit 26.

The basic signal generating unit 28X generates a basic signal sx corresponding to the resonance frequency f0*x* identified by the resonance frequency identifying unit 44X. More specifically, the basic signal generating unit 28X reads out resonance frequency information indicating the resonance frequency f0*x* identified by the resonance frequency identifying unit 44X from the resonance frequency storage unit 26X, and generates the basic signal sx corresponding to the resonance frequency f0*x* based on the resonance frequency information. The basic signal generating unit 28Y generates a basic signal sy corresponding to the resonance frequency f0*y* identified by the resonance frequency identifying unit 44Y. More specifically, the basic signal generating unit 28Y reads out resonance frequency information indicating the resonance frequency f0*y* identified by the resonance frequency identifying unit 44Y from the resonance frequency storage unit 26Y, and generates the basic signal sy corresponding to the resonance frequency f0*y* based on the resonance frequency information. The basic signal generating unit 28Z generates a basic signal sz corresponding to the resonance frequency f0*z* identified by the resonance frequency identifying unit 44Z. More specifically, the basic signal generating unit 28Z reads out resonance frequency information indicating the resonance frequency f0*z* identified by the resonance frequency identifying unit 44Z from the resonance frequency storage unit 26Z, and generates the basic signal sz corresponding to the resonance frequency f0*z* based on the resonance frequency information.

As described above, the present embodiment is further provided with the resonance frequency identifying unit 44 that identifies the resonance frequency f0 of the vibration sensor 18 by performing frequency analysis on the first reference signal r1. According to the present embodiment, since such a resonance frequency identifying unit 44 is provided, the resonance frequency information can be accurately updated even when the resonance frequency f0 of the vibration sensor 18 has fluctuated. Therefore, according to the present embodiment, it is possible to provide active noise control device 10 capable of reducing noise more suitably.

Third Embodiment

Figure 4:
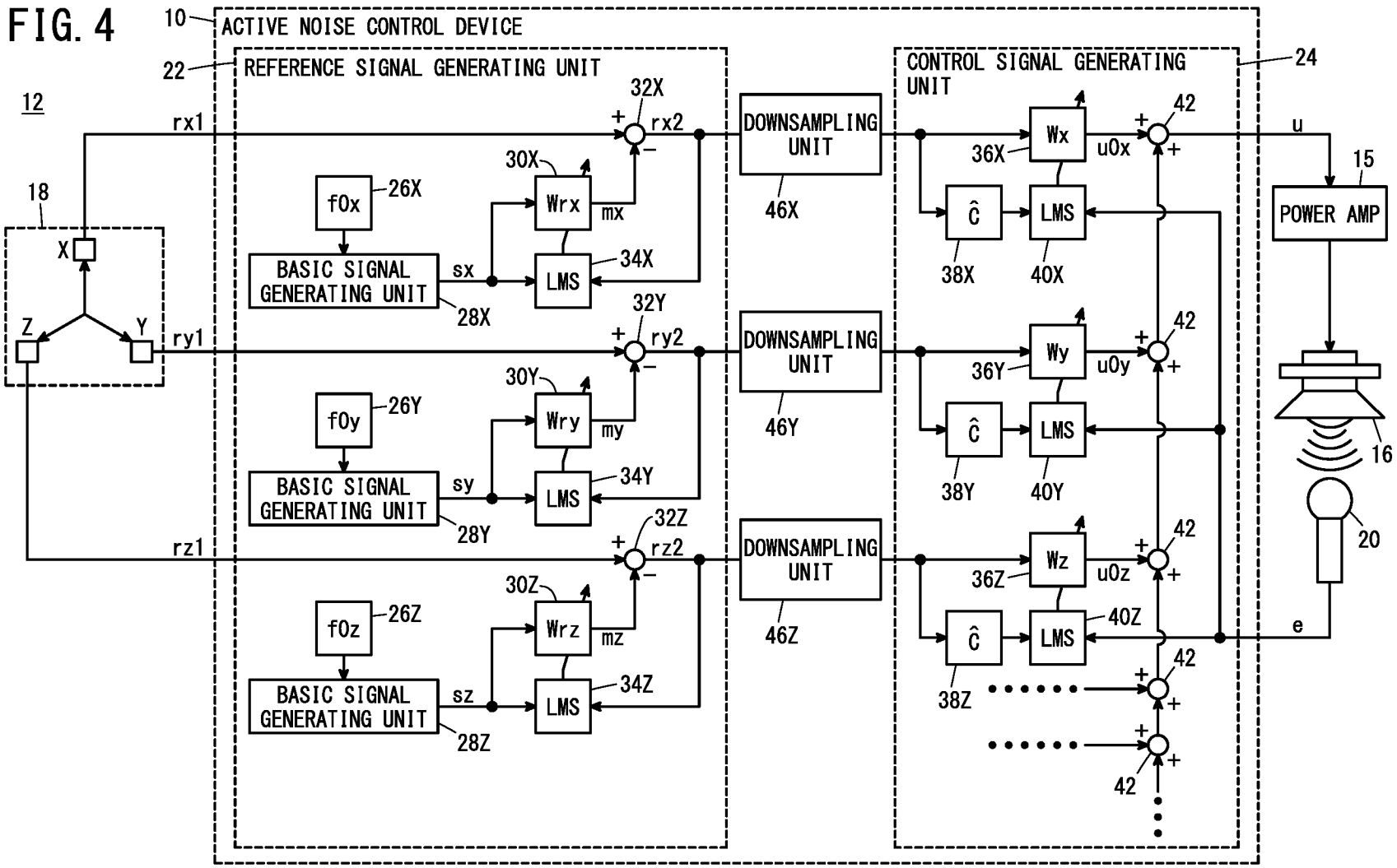
FIG. 4 is a block diagram illustrating a part of a vehicle provided with an active noise control device according to a third embodiment.

An active noise control device and a vehicle according to a third embodiment will be described with reference to FIG. 4. FIG. 4 is a block diagram illustrating a part of a vehicle equipped with the active noise control device according to the present embodiment. The same components as those of the active noise control device and the like according to the first or second embodiment shown in FIGS. 1 to 3 are denoted by the same reference characters, and description of such features is either omitted or simplified.

In the present embodiment, the sampling rate of each component included in the reference signal generating unit 22 is set to be twice or more as high as the sampling rate of each component included in the control signal generating unit 24. The sampling rate in the first adaptive filter 30X is set to be twice or more as high as the sampling rate in the second adaptive filter 36X. Further, the sampling rate in the first adaptive filter 30Y is set to be twice or more as high as the sampling rate in the second adaptive filter 36Y. Furthermore, the sampling rate in the first adaptive filter 30Z is set to be twice or more as high as the sampling rate in the second adaptive filter 36Z.

When the first reference signal r1 acquired by using the vibration sensor 18 is sampled at a relatively low sampling rate, aliasing noise (folding noise) corresponding to a component of the resonance frequency f0 is mixed into the control signal u, and the noise cannot always be cancelled suitably. On the other hand, in the present embodiment, since the processing for generating the second reference signal r2 is performed at a relatively high sampling rate, aliasing noise corresponding to the component of the resonance frequency f0 can be prevented from being mixed into the control signal u.

A downsampling unit 46X is provided between the first adaptive filter 30X and the second adaptive filter 36X. The second reference signal rx2 output from the computation unit 32X is input to the downsampling unit 46X. Then, the second reference signal rx2 downsampled by the downsampling unit 46X is input to the second adaptive filter 36X and the acoustic characteristic filter 38X.

Further, a downsampling unit 46Y is further provided between the first adaptive filter 30Y and the second adaptive filter 36Y. The second reference signal ry2 output from the computation unit 32Y is input to the downsampling unit 46Y. Then, the second reference signal ry2 downsampled by the downsampling unit 46Y is input to the second adaptive filter 36Y and the acoustic characteristic filter 38Y.

Further, a downsampling unit 46Z is further provided between the first adaptive filter 30Z and the second adaptive filter 36Z. The second reference signal rz2 output from the computation unit 32Z is input to the downsampling unit 46Z. Then, the second reference signal rz2 downsampled by the downsampling unit 46Z is input to the second adaptive filter 36Z and the acoustic characteristic filter 38Z. The reference character 46 is used when describing the downsampling unit in general, and the reference characters 46X, 46Y, and 46Z are used when describing the individual downsampling units.

As described above, the sampling rate in the first adaptive filter 30 may be set to be twice or more as high as the sampling rate in the second adaptive filter 36, and the downsampling unit 46 may be further provided between the first adaptive filter 30 and the second adaptive filter 36. According to the present embodiment, since the filtering process for generating the second reference signal r2 is performed at a relatively high sampling rate, aliasing noise corresponding to the component of the resonance frequency f0 can be suitably prevented from being mixed into the control signal u. Therefore, according to the present embodiment, it is possible to provide the active noise control device 10 that is capable of reducing noise more suitably.

Although preferred embodiments of the present invention have been described above, the present invention is not limited to the above-described embodiments, and various modifications can be made thereto without departing from the essence and gist of the present invention.

The embodiments described above can be summarized in the following manner.

The active noise control device (10) causes the actuator (16) to output the canceling sound based on the control signal (u) in order to reduce noise in the vehicle compartment (14) of the vehicle (12), and includes the basic signal generating unit (28X, 28Y, 28Z) configured to generate the basic signal (sx, sy, sz) corresponding to the resonance frequency (f0*x*, f0*y*, f0*z*) of the vibration sensor (18) provided at the vehicle, the first adaptive filter (30X, 30Y, 30Z) configured to generate the sensor resonance simulation signal (mx, my, mz) simulating the signal acquired while the vibration sensor is resonating by performing a filtering process on the basic signal, the computation unit (32X, 32Y, 32Z) configured to calculate the second reference signal (rx2, ry2, rz2) that is a difference between the first reference signal (rx1, ry1, rz1) acquired by the vibration sensor and the sensor resonance simulation signal, and the second adaptive filter (36X, 36Y, 36Z) configured to generate the control signal by performing a filtering process on the second reference signal, the filtering process being different from the filtering process performed by the first adaptive filter. According to such a configuration, the second reference signal is generated by the difference between the first reference signal acquired by the vibration sensor and the sensor resonance simulation signal that simulates a signal acquired while the vibration sensor is resonating. Since the second reference signal is generated by the difference between the first reference signal and the sensor resonance simulation signal, the magnitude of the component of the resonance frequency of the vibration sensor is reduced in the second reference signal. According to such a configuration, since the control signal for outputting the canceling sound from the actuator is generated based on such a second reference signal, it is possible to provide an active noise control device capable of suitably reducing noise even when the vibration sensor has resonated.

The active noise control device may further include the first filter coefficient updating unit (34X, 34Y, 34Z) configured to update the filter coefficient (Wrx, Wry, Wrz) of the first adaptive filter in a manner that a magnitude of a component of the resonance frequency of the vibration sensor is minimized in the second reference signal. According to such a configuration, the magnitude of the component of the resonance frequency of the vibration sensor can be sufficiently reduced in the second reference signal even when the resonance frequency has fluctuated and/or even when the magnitude of the component of the resonance frequency has fluctuated. Therefore, according to such a configuration, it is possible to provide an active noise control device that is capable of acquiring a much better second reference signal corresponding to vibration of the vehicle, and reducing noise more suitably even when the vibration sensor has resonated.

The active noise control device may further include the resonance frequency storage unit (26X, 26Y, 26Z) configured to store resonance frequency information indicating the resonance frequency of the vibration sensor, wherein the basic signal generating unit is configured to generate the basic signal corresponding to the resonance frequency of the vibration sensor based on the resonance frequency information stored in the resonance frequency storage unit.

The active noise control device may further include the resonance frequency identifying unit (44X, 44Y, 44Z) configured to identify the resonance frequency of the vibration sensor by performing frequency analysis on the first reference signal, wherein the basic signal generating unit may be configured to generate the basic signal corresponding to the resonance frequency identified by the resonance frequency identifying unit. According to such a configuration, even when the resonance frequency of the vibration sensor has fluctuated, the resonance frequency information can be accurately updated. Therefore, according to such a configuration, it is possible to provide an active noise control device that is capable of reducing noise more suitably.

The sampling rate of the first adaptive filter may be twice or more as high as the sampling rate of the second adaptive filter, and the active noise control device may further include the downsampling unit (46X, 46Y, 46Z) located between the first adaptive filter and the second adaptive filter. According to such a configuration, since the filtering process for generating the second reference signal is performed at a relatively high sampling rate, aliasing noise corresponding to the component of the resonance frequency can be suitably prevented from being mixed into the control signal. Therefore, according to such a configuration, it is possible to provide an active noise control device that is capable of reducing noise more suitably.

The active noise control device may further include the second filter coefficient updating unit (40X, 40Y, 40Z) configured to update the filter coefficient (Wx, Wy, Wz) of the second adaptive filter in a manner that the error signal (e) is minimized, the error signal being acquired by detecting, with the microphone (20), residual noise due to interference between the noise and the canceling sound. According to such a configuration, since the filter coefficient of the second adaptive filter is suitably updated, it is possible to provide an active noise control device that is capable of reducing noise more suitably.

The vehicle includes the active noise control device as described above.

What is claimed is:

1. An active noise control device that causes an actuator to output a canceling sound based on a control signal in order to reduce noise in a vehicle compartment of a vehicle, the active noise control device comprising one or more processors that execute computer-executable instructions stored in a memory, wherein the one or more processors execute the computer-executable instructions to cause the active noise control device to:

generate a basic signal corresponding to a resonance frequency of a vibration sensor provided at the vehicle;

generate a sensor resonance simulation signal simulating a signal acquired while the vibration sensor is resonating by performing a filtering process on the basic signal, with a first adaptive filter;

calculate a second reference signal that is a difference between a first reference signal acquired by the vibration sensor and the sensor resonance simulation signal; and generate the control signal by performing a filtering process on the second reference signal with a second adaptive filter, the filtering process performed with the second adaptive filter being different from the filtering process performed with the first adaptive filter, wherein the one or more processors cause the active noise control device to:

identify the resonance frequency of the vibration sensor by performing frequency analysis on the first reference signal, and generate the basic signal corresponding to the identified resonance frequency.

2. The active noise control device according to claim 1, wherein the one or more processors cause the active noise control device to update a filter coefficient of the first adaptive filter in a manner that a magnitude of a component of the resonance frequency of the vibration sensor is minimized in the second reference signal.

3. The active noise control device according to claim 1, wherein the one or more processors cause the active noise control device to:

store resonance frequency information indicating the resonance frequency of the vibration sensor, and generate the basic signal corresponding to the resonance frequency of the vibration sensor based on the stored resonance frequency information.

4. The active noise control device according to claim 1, wherein a sampling rate of the first adaptive filter is twice or more as high as a sampling rate of the second adaptive filter, and the one or more processors cause the active noise control device to perform downsampling between the first adaptive filter and the second adaptive filter.

5. The active noise control device according to claim 1, wherein the one or more processors cause the active noise control device to update a filter coefficient of the second adaptive filter in a manner that an error signal is minimized, the error signal being acquired by detecting, with a microphone, residual noise due to interference between the noise and the canceling sound.

6. A vehicle comprising an active noise control device that causes an actuator to output a canceling sound based on a control signal in order to reduce noise in a vehicle compartment of the vehicle, the active noise control device including one or more processors that execute computer-executable instructions stored in a memory, wherein the one or more processors execute the computer-executable instructions to cause the active noise control device to:

generate a basic signal corresponding to a resonance frequency of a vibration sensor provided at the vehicle;

generate a sensor resonance simulation signal simulating a signal acquired while the vibration sensor is resonating by performing a filtering process on the basic signal, with a first adaptive filter;

calculate a second reference signal that is a difference between a first reference signal acquired by the vibration sensor and the sensor resonance simulation signal; and generate the control signal by performing a filtering process on the second reference signal with a second adaptive filter, the filtering process performed with the second adaptive filter being different from the filtering process performed with the first adaptive filter, wherein the one or more processors cause the active noise control device to:

identify the resonance frequency of the vibration sensor by performing frequency analysis on the first reference signal, and generate the basic signal corresponding to the identified resonance frequency.

* * * * *